United States Patent [19]

Inman

[11] 3,960,797

[45] June 1, 1976

[54] WATER-IN-OIL EMULSIONS OF FLUOROALKYL POLYMER, CHLORINATED ALKANE SOLVENT AND NON-IONIC SURFACTANT

[75] Inventor: Charles Edward Inman, Glenside, Pa.

[73] Assignee: Pennwalt Corporation, Philadelphia, Pa.

[22] Filed: Dec. 28, 1973

[21] Appl. No.: 429,465

[52] U.S. Cl. ..... 260/29.6 F; 260/29.6 ME; 428/421

[51] Int. Cl.[2] ..... C08L 27/12

[58] Field of Search ..... 260/29.6 F

[56] References Cited

UNITED STATES PATENTS

| | | | |
|---|---|---|---|
| 3,304,278 | 2/1967 | Hauptschein et al. | 260/29.6 F |
| 3,356,628 | 12/1967 | Smith et al. | 260/29.6 F |
| 3,532,659 | 10/1970 | Hager et al. | 260/29.6 F |
| 3,544,663 | 12/1970 | Hauptschein et al. | 260/29.6 F |

*Primary Examiner*—Harold D. Anderson

[57] ABSTRACT

An emulsion suitable for imparting oil and water repellency to substrates comprised of a major proportion of chlorinated alkane solvent and minor proportions of finely-dispersed fluoroalkyl polymer, water, and a nonionic surfactant of the polyoxyethylene adduct type having an HLB value of at least 8.

10 Claims, No Drawings

WATER-IN-OIL EMULSIONS OF FLUOROALKYL POLYMER, CHLORINATED ALKANE SOLVENT AND NON-IOINIC SURFACTANT

The present invention concerns a stabilized water-in-oil emulsion of a fluorochemical polymer latex in chlorinated alkane solvent containing selected nonionic surfactant as an emulsion stabilizer.

It is wide commercial practice to apply a fluorochemical polymer to some fabrics and other substrates to impart oil and water repellency characteristics thereto. Generally, the polymer is applied to the fabric as a latex in an aqueous bath. In recent years, however, a major trend has developed toward application of fluorochemical textile finishes from organic solvent media, and in particular, nonflammable solvents such as the chlorinated alkanes. Many advantages are inherent in solvent finishing; for example, there is a lower initial outlay of expenditures for equipment and working space; the cost of process water and of treating aqueous effluents is eliminated; and power consumption is reduced. The use of solvent-applied finishes on expensive upholstery is also desirable to maintain the "loft" in the pattern and the sheen. Solvent finishes are also ideally suited for use by commercial dry-cleaners, who often employ conventional dry cleaning equipment and solvents for both cleaning and refurbishing of rainwear. In addition, solvent finishes may be applied to textiles from aerosols which are convenient for the home consumer.

The customary means of preparing a textile finish for solvent application is to dissolve the active ingredient in a suitable organic solvent. In the case of the fluorochemical textile finishes, however, this presents a problem because this class of compounds have inherent insolvency in most non-polar solvents. There has been some efforts in the art to develop fluorochemical polymers and resins which are solvent-soluble. Unfornately, however, when solvency is achieved, the fluorochemical materials have a tendency to migrate on the fabric during application, and show little or no durability to dry cleaning. One means devised to overcome these difficulties has been to prepare water-in-oil emulsions of commercially available fluorochemical polymer aqueous-based latexes for solvent system finishing of textiles, which water-in-oil emulsions provide all of the advantages of solvent processing. Some such emulsion systems have been described in the patent literature: Eanzel et al, U.S. Pat. No. 3,657,173, concerns a water-in-oil (halogenated solvent) emulsion of fluorine-containing polymer, containing therein an alkanol of 1 to 5 carbon atoms as an emulsion stabilizer. Rapp, U.S. Pat. No. 3,668,163, concerns a water-in-oil emulsion comprised of an aqueous dispersion (latex) of fluorinated polymer, chlorinated alkane solvent, a wax-melamine derivative, and as emulsion stabilizer, a long chain alkyl benzene sulfonate salt (an anionic surfactant).

The composition of this invention is a water-in-oil emulsion suitable for imparting water-and/or oil-repellency properties to substrates (e.g., textiles) comprised of a major proportion of chlorinated alkane solvent having one to three carbon atoms, a minor proportion of water, a minor proportion of finely-dispersed solid fluoroalkyl polymer (derived from an aqueous latex thereof), said polymer having hydrophobic and oleophobic characteristics, and a minor proportion, but effective emulsion-stabilizing amount, of at least one nonionic surfactant selected from the class of polyoxyethylene adducts of sorbitan fatty acid esters, glycerol fatty acid esters, fatty acids and fatty alcohols having 16 to 18 carbon atoms in the fatty acid or alcohol moiety, said nonionic surfactant or mixtures thereof having an HLB value of at least 8. Within the broad definition of the composition of the invention as above stated, it may comprise, based on 100 parts by weight of emulsion, from about 0.1 to about 30 parts by weight water, from about 0.05 to about 10 parts by weight fluoroalkyl polymer solids, from about 0.005 to about 5 parts by weight of surfactant, and the balance chlorinated alkane solvent.

In preparing the composition embodied herein, an emulsion concentrate is first produced by high-shear mixing of the fluoroalkyl polymer latex with the chlorinated alkane solvent and the nonionic surfactant. It is advantageous, however, to first add the surfactant to the solvent, and then add the polymer latex thereto while vigorously agitating the mixture. The emulsion concentrate will normally contain, based on 100 parts by weight of emulsion, from about 1 to 10 parts of polymer solids, from about 4 to 30 parts water, from about 0.2 to 5 parts surfactant, the balance comprising solvent.

The emulsion concentrate prepared as above described is usually storage-stable for an adequate time, e.g., periods usually greater than 2 hours and generally more than 24 hours. If some phase separation does result after long storage periods, a short stirring or shaking will generally restore emulsion homogeneity. Before application to the fabric or other substrate, the emulsion concentrate is normally diluted with additional quantity of chlorinated alkane solvent, thereby regulating the amount of subsequent pick-up of repellent on the substrate. The constituency of these "working" emulsions, based on 100 parts by weight of emulsion, is generally from about 0.05 to 1 part polymer solids, from about 0.1 to 10 parts water, from about 0.005 to 1 part surfactant, the remainder comprising solvent. Stated in different terms, the water-in-oil emulsions of this invention contain from 0.01 to 10% by weight of the fluorochemical water and oil repellent polymer, preferably 5–10% for the emulsion concentrate and 0.05 to 0.5% for the working solutions. The amount of water in the composition may vary according to the concentration of fluorochemical polymer latex used but preferrably should be kept to a minimum in order to minimize problems of its removal from the treated fabric and its deleterious effects upon the fabric. The amount of stabilizing or emulsifying surfactant usually lies between 0.1 and 5% by weight of emulsion. Preferably, however, the concentration of surfactant in the working solution should be kept below about 1% in order to minimize rewetting of the fabrics. The chlorinated-alkane solvent comprises the remaining portion of the composition.

The water-in-oil emulsion compositions may be applied to fabrics and textiles by conventional techniques such as spraying, padding, dipping, roller coating or a combination of these methods. Cure may be effected by heating on rolls, in an oven, or on a pressing mangel. In accordance with customary fabric finishing practice of applying two or more treatments to a substrate simultaneously, the emulsion compositions may have admixed therewith additional agents, including conventional non-fluorinated polymer extenders for the fluorochemical repellent, hydrocarbon-based repellents, softeners, permanent-press resins, and other fabric treatment agents.

Although the component ingredients of the present water-in-oil emulsions are familiar in the art, their combination and the results thereof are unique. However, for purposes of clarification further information regarding such constituent ingredients is presented hereinbelow.

The fluorochemical polymers embodied in the compositions of this invention are essentially polymers and copolymers containing $C_6$-$C_{16}$ fluorinated alkyl side chains or "tails" which contribute oil and water repellency to the composition. Such fluorochemical polymers in the form of latexes, i.e., aqueous dispersions of finely-particulate solids, may be employed alone as a repellent finish for textiles or may be physically mixed or diluted with selected nonfluorine-containing polymer and copolymer latexes. Preferred fluoropolymers of this type are the aqueous latices of acrylate and methacrylate polymers and copolymers having said long chain (e.g., $C_6$-$C_{16}$) fluorinated alkyl groups pendant thereon. Representative and typical of such preferred fluorochemical agents are the following: U.S. Pat. No. 3,068,187 describing copolymers based on the monomer $R_fSO_2N(CH_2CH_3)CH_2CH_2OOC(CH_3)C{=}CH_2$ where $R_f$ is perfluoroalkyl of at least four carbon atoms; U.S. 3,378,609 describing a polymer or copolymer of $R_fCH_2CH_2OOC(CH_3)C{=}CH_2$; U.S. 3,544,633 describing polymers and copolymers of $R_fCH_2CH_2SOC(CH_3)C{=}CH_2$; and the acrylate homologs of the foregoing methacrylate fluoroalkyl monomers. Other representative fluorochemical polymeric agents operable in the present invention are described in U.S. Pat. Nos. 3,102,103; 3,248,260; 3,256,230; 3,256,231; 3,277,039; 3,282,905; 2,803,615, 3,385,812; 3,384,627; 3,386,977; 3,395,174; 3,428,709; 3,457,247; 3,497,575; 3,356,628; 3,532,659; and 3,547,861. The aqueous latexes of such polymers generally contain from about 10 to about 50 percent by weight of polymer solids.

The chlorinated alkane solvent constituting the "oil" segment of the emulsion of this invention is, in general, one having 1 to 3 carbon atoms, such as perchloroethylene, trichloroethylene, 1,1,2-trichloro-1,2,2-trifluoroethane, carbon tetrachloride, methylene chloride, methyl chloroform, 1,1,2,2-tetrachloro-1,2-difluoroethane, trichlorofluoromethane, 1,1,1-trichloro-2,2,3,3,3-pentafluoropropane, and the like. The solvents methyl chloroform, trichloroethylene and perchloroethylene are preferred herein as they give good results and are relatively inexpensive.

The nonionic surfactant embodied in the composition of this invention is selected from the class consisting of polyoxyethylene adducts of sorbitan fatty acid esters, polyoxyethylene adducts of glycerol fatty acid esters, and the polyoxyethylene adducts of fatty acids and fatty alcohols, said fatty acid or alcohol moieties having from 16 to 18 carbon atoms. Such fatty acids are exemplified by palmitic, stearic, palmitoleic, oleic, ricinoleic, linoleic, linolenic, and the like, and mixtures thereof. The foregoing surfactants are described in the Kirk-Othmer "Encyclopedia of Chemical Technology", 2nd Edition, Vol. 19 (1969) pp 531 et. seq. The surfactant suitable for the compositions of this invention (and including mixtures of surfactants) is further characterized by having a Hydrophile-Lipophile Balance (referred to as the "HLB") of greater than 8, and ranging, as a practical value, up to about 20. Preferably, the HLB value is in the range of about 10 to 18. The HLB characterization of surfactants is described in detail in the brochure "The Atlas HLB System", 1963, Atlas Chemical Industries, Inc., Wilmington, Del., and in articles by W. C. Griffin, J. Soc. Cosmetic Chemists, Vol. 1, p. 311 (1949) and Vol. 5, p. 249 (1964). It is indeed surprising that the HLB values of the nonionic surfactants incorporated in the compositions of this invention are not in the range that would be predicted as operable for water-in-oil emulsions based on either Griffin's original HLB concept or on Scatchard-Hildebrand's cohesive energy theory (see Beerbower, H. and Hill, M. W., "The Cohesive Energy Ratio of Emulsions-A Fundamental Basis for the HLB Concept", McCutcheon's *Detergents and Emulsifiers* (1971), Allured Publishing Corp., Ridgewood, N.J.)

The following illustrative examples demonstrate the criticality and specificity required in selecting a nonionic surfactant of the required chemical type and having the proper Hydrophile-Lipophile Balance (HLB) in order to obtain stable emulsions in accordance with this invention.

EXAMPLE 1

A series of compositions having the general formulation as follows are prepared as described below:

100 g. Methylchloroform
1 g. Surfactant
25 g. Fluorochemical polymer latex of type described in U.S. Pat. No. 3,544,633, derived from the monomer $$R_fCH_2CH_2SC{-}\overset{\overset{\displaystyle O}{\|}}{C}{=}\overset{\overset{\displaystyle CH_3}{|}}{C}H_2{}^{*}$$

*A 20% solids dispersion made by mixing, on a 50/50 solids basis, an emulsion copolymer of 80% $C_8F_{19}C_2H_4SC(O)C(CH_3){=}CH_2$ and 20% stearyl methacrylate with an emulsion copolymer of 71% butyl methacrylate, 24% of 3,5,5-trimethylhexyl methacrylate and 5% N-methylolacrylamide.

The methylchloroform and the surfactant are added to a standard Waring Blender and mixed at a "slow" speed. The fluorochemical polymer latex is then added over a period of 30 seconds and mixing is continued for two minutes. The resulting water-in-oil emulsions are set aside for periodic observation.

Table 1, below, exemplifies nonionic surfactants giving acceptable results in stabilizing the emulsion and Table 2 lists inoperable surfactants noted in this series of tests.

TABLE I

| Surfactant Chemical Type | HLB | Emulsion Stability Observations 2 Hours | 24 Hours |
|---|---|---|---|
| Polyoxyethylene Sorbitan Monopalmitate ("Tween 40") | 15.6 | Stable | Stable |
| Polyoxyethylene Sorbitan Monostearate ("Tween 60") | 14.9 | Stable | Stable |
| Polyoxyethylene Sorbitan Monooleate ("Tween 80") | 15.0 | Stable | Stable |
| Polyoxyethylene Stearyl Ether ("Brij 78") | 15.3 | Stable | Stable |
| Polyoxyethylene Oleyl Ether ("Brij 98") | 15.3 | Stable | Stable |
| Polyoxyethylene Stearate ("Myrj 52") | 16.9 | Stable | Stable |
| Polyoxyethylene ($C_{18}$) Fatty Glyceride ("Atlas G-1292") | 11.0 | Stable | Stable |

TABLE 2

| Surfactant Type | HLB | Emulsion Stability Observations 2 Hours | 24 Hours |
|---|---|---|---|
| Sorbitan Monolaurate ("Span 20") | 8.6 | Creamed | Separated |
| Sorbitan Monooleate ("Span 80") | 4.3 | Creamed | Separated |
| Polyoxyethylene Sorbitan Monolaurate ("Tween 20") | 16.6 | Slightly Creamed | Creamed |
| Polyoxyethylene Lauryl Ether ("Brij 35") | 16.9 | Slightly Separated | Separated |
| Polyoxyethylene Tridecyl Ether ("Renex 31") | 15.4 | Slightly Separated | Separated |
| Octylphenoxy Polyethoxy Ethanol ("Triton X-305") | 17.3 | Slightly Separated | Separated |
| Alkylaryl Polyether Alcohol ("Triton X-155") | 12.5 | Slightly Separated | Separated |

The following Table 3 shows the results of mixtures of two surfactants. In certain cases, although one of the surfactants may have been shown to be inoperable by itself, the combination thereof with another nonionic surfactant gives a mixture which falls within the desired HLB range.

TABLE 3

| Surfactant Type | HLB | Emulsion Stability Observations 2 Hours | 24 Hours |
|---|---|---|---|
| 12/88 Mix of "Tween 80" and "Span 80" | 4.0 | Creamed | Separated |
| 17/83 Mix of "Tween 80" and "Span 80" | 6.0 | Creamed | Creamed and Slightly Separated |
| 35/65 Mix of "Tween 80" and "Span 80" | 8.0 | Stable | Stable |
| 54/46 Mix of "Tween 80" and "Span 80" | 10.0 | Stable | Stable |
| 72/28 Mix of "Tween 80" and "Span 80" | 12.0 | Stable | Stable |
| 50/50 MIx of "Brij 78" and "Myrj 52" | 16.1 | Stable | Stable |
| 50/50 Mix of "Tween 60" and "Myrj 52" | 15.9 | Stable | Stable |
| 50/50 Mix of "Tween 60" and "Brij 78" | 15.1 | Stable | Stable |

EXAMPLE 2

Water-in-oil emulsions of perfluoroalkyl polymer latexes are prepared according to the recipe and procedure of Example 1 using either a nonionic or anionic surfactant as emulsion stabilizer. The emulsions are diluted with methylchloroform solvent to a working concentration (e.g., about 0.12 to 0.2 weight percent solids) such that a solids pick-up of 0.2% on weight of fabric is obtained when the emulsions are padded onto representative fabrics using an Atlas laboratory padder. The fabrics are allowed to air-dry, and then are cured in an air-circulating oven at 150°C. for 3 minutes. The treated fabrics are tested for water repellency using A.A.T.C.C. Test Method 22-1952 of American Association of Textile Chemists and Colorists. A rating of 100 denotes no water penetration or surface adhesion, a rating of 90 denotes slight random sticking or wetting, while lower ratings denote increasing water wettability. The treated fabrics in the examples are tested for oil repellency using A.A.T.C.C. test method 118–1966. The test involves placing a drop of Test Solution, described below, on the textile fixed on a horizontal surface. After 2 minutes, any penetration or wicking into the fabric is noted visually. The textile is given a number rating of one to nine in order of increasing oil repellency. Any textile with a rating of five or more is considered to have good oil repellency. Any textile with a rating of one or more can be used for certain oil repellency purposes. The oil repellency rating of the test solutions set forth by the A.A.T.C.C. test are shown as follows:

| Oil Repellency Rating | Test Solution |
|---|---|
| 9 | n-Hexane |
| 8 | n-Heptane |
| 7 | n-Octane |
| 6 | n-Decane |
| 5 | n-Dodecane |
| 4 | n-Tetradecane |
| 3 | n-Hexadecane |
| 2 | 50-50 Hexadecane/Nujol |
| 1 | Nujol |

The data in Table 4 illustrates the unexpectedly improved water repellency obtained on fabrics treated with the described formulations containing nonionic surfactants. When the emulsions are padded onto fabrics with a solids pick-up of 0.5% on weight of fabric, the repellency results are unchanged, thus showing the effects obtained to be independent of repellent loading in the range investigated.

TABLE 4

| Surfactant | Ionic Type | AATCC Repellency Rating, Oil/Water 80×80 Cotton Print Cloth | Polyester Knit | Woven Spun Orlon | Nylon Taffeta | 65/35 Dacron-Cotton Rainwear |
|---|---|---|---|---|---|---|
| Alkylaryl Sulfonate ("Atlas G-3300") | Anionic | 7/70 | 7/80 | 5/80 | 5/80 | 5/70 |
| 91/9 Mix of Polyoxyethylene Sorbitan Monooleate ("Tween 80") and Sorbitan Monoleate ("Span 80") | Nonionic | 7/100 | 7/100 | 7/100 | 7/100 | 6/100 |
| Alkylaryl Sulfonate Blend ("Valwet 092") | Anionic | 7/80 | 7/80 | 7/50 | 5/90 | 5⁺/70 |
| 50/50 Mix of Polyoxyethylene Stearyl Ether ("Brij 78") and Polyoxyethylene Stearate ("Myrj 52") | Nonionic | 7/100 | 7/100 | 7/100 | 7/100 | 6/90 |
| Sodium Alkane Sulfonate ("Alkanol 1895") | Anionic | 7/70 | 7/70 | 5/70 | 5/90 | 6/70 |
| Sodium Alkylaryl Sulfonate ("Alkanol DW") | Anionic | 7/50 | 6/70 | 5/70 | 5/90 | 7/50 |
| 50/50 Mix of "Tween 60" and "Brij 78" | Nonionic | 7/100 | 6/100 | 7/100 | 6/100 | 7/100 |
| 50/50 Mix of Polyoxyethylene Sorbitan Monostearate ("Tween 60") and Polyoxyethylene Stearate ("Myrj 52") | Nonionic | 7/100 | 7/100 | 7/100 | 7/100 | 7/100 |
| Sodium Alkylaryl Polyether Sulfate ("Triton 200") | Anionic | 7/80 | 6/70 | 6/70 | 5/80 | —* |
| Polyoxyethylene Fatty Glyceride ("Atlas G-1292") | Nonionic | 7/100 | — | 6/200 | — | — |

TABLE 4-continued

| Surfactant | Ionic Type | AATCC Repellency Rating, Oil/Water 80×80 Cotton Print Cloth | Polyester Knit | Woven Spun Orlon | Nylon Taffeta | 65/35 Dacron-Cotton Rainwear |
|---|---|---|---|---|---|---|
| 2-Propanol (Formulation according to Exp. 2 of U.S. 3,657,173) | Not applicable | 7/80 | — | — | — | — |

*Indicates no measurement made.

EXAMPLE 3

Employing the recipe and preparative procedure of Example 1, two water-in-oil emulsions of fluorochemical polymers are prepared using as the nonionic surfactants a 50/50 mixture (HLB=15.9) of polyoxyethylene sorbitan monostearate ("Tween 60") and polyoxyethylene stearate ("Myrj 52"). One of the emulsions is made with an aqueous dispersion of fluoropolymer based on the monomer $R_fSO_2N(CH_2CH_3)C_2H_4OOC(CH_3)C{=}CH_2$ ("FC-208" fluorotelomer latex, Minnesota Mining and Manufacturing Company) described in U.S. Pat. No. 3,068,187, and the other emulsion is made with an aqueous dispersion of fluoropolymer based on the monomer $R_fC_2H_4OOC(CH_3)C{=}CH_2$ ("Zepel B" fluorotelomer latex, E. I. duPont de Nemours Co.) described in U.S. Pat. NO. 3,378,609.

The emulsion compositions, which are stable for more than 72 hours, are applied to cotton fabric as described in the previous example and produce oil/water repellency ratings of 6/100 and 7/100, respectively.

What I claim is:

1. A composition in the form of an emulsion, or which can readily be converted into an emulsion by shaking, consisting essentially of a major proportion of chlorinated alkane solvent having one to three carbon atoms and minor proportions of water and finely-dispersed fluoroalkyl polymer solids containing pendant $C_6$ to $C_{16}$ fluoroalkyl groups and having oil and water repellent properties, said fluoroalkyl polymer solids being present in a minimum amount of about 0.05 parts per 100 parts by weight of emulsion, and an emulsion-stabilizing amount of nonionic surfactant having an HLB value of from 8 to about 20 and which is selected from the group consisting of the polyoxyethylene adducts of sorbitan fatty acid ester, glycerol fatty acid esters, fatty acids, and fatty alcohols, wherein there are 16 to 18 carbon atoms in the fatty acid or fatty alcohol moiety.

2. The composition of claim 1 which consists essentially of, based on 100 parts by weight of emulsion, from about 0.1 to about 30 parts by weight water, from about 0.05 to about 10 parts by weight fluoroalkyl polymer, from about 0.005 to about 5 parts by weight of said surfactant, and the remainder chlorinated alkane solvent.

3. The composition of claim 1 which consists essentially of, based on 100 parts by weight of emulsion, from about 4 to 30 parts water, from about 1 to 10 parts fluoroalkyl polymer, from about 0.2 to 5 parts of said surfactant, and the balance chlorinated alkane solvent.

4. The composition of claim 1 wherein the solvent is selected from the group consisting of methylchloroform, trichlorofluoromethane, methylene chloride, carbon tetrachloride, perchloroethylene, trichloroethylene, 1,1,2,2-tetrachloro-1,2-difluoroethane, 1,1,2-trichloro-1,2,2-trifluoroethane and 1,1,1-trichloro-2,2,3,3,3-pentafluoropropane.

5. The composition according to claim 1 wherein the solvent is methylchloroform.

6. The composition according to claim 1 wherein the solvent is trichloroethylene.

7. The composition according to claim 1 wherein the solvent is perchloroethylene.

8. The composition according to claim 1 where the fluoroalkyl polymer is of the monomer $R_fSO_2N(CH_2CH_3)C_2H_4OOC(CH_3)C{=}CH_2$ where $R_f$ is perfluoroalkyl.

9. The composition according to claim 1 wherein the fluoroalkyl polymer is of the monomer $R_fC_2H_4OOC(CH_3)C{=}CH_2$ where $R_f$ is perfluoroalkyl.

10. The composition according to claim 1 wherein the fluoroalkyl polymer is of the monomer $R_fCH_2CH_2SOC(CH_3)C{=}CH_2$ where $R_f$ is perfluoroalkyl.

* * * * *